US006962008B2

(12) United States Patent
Manz et al.

(10) Patent No.: US 6,962,008 B2
(45) Date of Patent: Nov. 8, 2005

(54) FULL BEARING 3D CUSHIONING SYSTEM

(75) Inventors: Gerd Rainer Manz, Weisendorf (DE); Jan Hill, Weisendorf (DE); Michael Steszyn, Portland, OR (US); Berthold Krabbe, Scheinfeld (DE)

(73) Assignee: adidas International Marketing B.V., (NL)

( * ) Notice: Subject to any disclaimer, the term of this patent is extended or adjusted under 35 U.S.C. 154(b) by 78 days.

(21) Appl. No.: 10/339,785

(22) Filed: Jan. 10, 2003

(65) Prior Publication Data

US 2004/0055182 A1 Mar. 25, 2004

(30) Foreign Application Priority Data

Sep. 24, 2002 (DE) ..... 102 44 435

(51) Int. Cl.[7] ..... A43B 13/14
(52) U.S. Cl. ..... 36/25 R; 36/103; 36/28; 36/59 C
(58) Field of Search ..... 36/103, 25 R, 36/27, 28, 59 R, 59 C

(56) References Cited

U.S. PATENT DOCUMENTS

| | | | | |
|---|---|---|---|---|
| 1,165,235 A | | 12/1915 | Emery | |
| 2,535,102 A | * | 12/1950 | Taylor | 36/38 |
| 2,908,983 A | * | 10/1959 | Berke | 36/39 |
| 2,931,110 A | | 4/1960 | Pietrocola | |
| 3,251,076 A | | 5/1966 | Burke | |
| 3,477,150 A | * | 11/1969 | Shepherd | 36/39 |
| 3,478,447 A | * | 11/1969 | Gillead | 36/36 B |
| 3,631,614 A | | 1/1972 | Rice | |
| 3,782,011 A | * | 1/1974 | Fisher | 36/59 R |
| 4,196,903 A | | 4/1980 | Illustrato | |
| 4,262,434 A | | 4/1981 | Michelotti | |
| 4,364,188 A | | 12/1982 | Turner et al. | |
| 4,843,735 A | | 7/1989 | Nakanishi | |
| 4,956,927 A | | 9/1990 | Misevich et al. | |
| D312,723 S | | 12/1990 | Okada | |
| 5,138,776 A | | 8/1992 | Levin | |
| 5,224,278 A | | 7/1993 | Jeon | |
| 5,224,810 A | | 7/1993 | Pitkin | |
| 5,233,767 A | | 8/1993 | Kramer | |

(Continued)

FOREIGN PATENT DOCUMENTS

DE 41 14 551 5/1992

(Continued)

OTHER PUBLICATIONS

Photo of Reebok's Premier Series Shoes and English language translation of text.

(Continued)

*Primary Examiner*—Ted Kavanaugh
(74) *Attorney, Agent, or Firm*—Goodwin Procter LLP

(57) ABSTRACT

The invention relates to a sliding element for a shoe sole. The sliding element includes an upper sliding surface and a lower sliding surface, wherein the lower sliding surface is arranged below the upper sliding surface so as to be slideable in at least two directions. The upper sliding surface can form a lower side of an upper sliding plate and the lower sliding surface can form an upper side of a lower sliding plate. A relative sliding movement between the upper sliding surface and the lower sliding surface distributes the deceleration of the shoe sole over a greater time period and allows the foot to feel as if it is wearing a conventional shoe that contacts a surface with reduced friction, for example, a soft forest ground. As a result, the force acting on the wearer and the momentum transfer on his or her muscles and bones are reduced.

25 Claims, 4 Drawing Sheets

U.S. PATENT DOCUMENTS

| | | | |
|---|---|---|---|
| 5,279,051 | A | 1/1994 | Whatley |
| 5,337,492 | A | 8/1994 | Anderié et al. |
| 5,343,639 | A | 9/1994 | Kilgore et al. |
| 5,353,523 | A | 10/1994 | Kilgore et al. |
| 5,493,791 | A | 2/1996 | Kramer |
| 5,517,770 | A | 5/1996 | Martin et al. |
| 5,560,126 | A | 10/1996 | Meschan et al. |
| 5,572,804 | A | 11/1996 | Skaja et al. |
| 5,607,749 | A | 3/1997 | Strumor |
| D385,393 | S | 10/1997 | Wong |
| 5,689,902 | A | 11/1997 | Juang |
| 5,752,329 | A | 5/1998 | Horibata |
| 5,832,629 | A | 11/1998 | Wen |
| 5,853,844 | A | 12/1998 | Wen |
| 5,881,478 | A | 3/1999 | McMahon et al. |
| 5,933,983 | A | 8/1999 | Jeon |
| 5,937,544 | A | 8/1999 | Russell |
| 5,983,529 | A | 11/1999 | Serna |
| 6,006,449 | A | 12/1999 | Orlowski et al. |
| 6,023,859 | A | 2/2000 | Burke et al. |
| 6,050,002 | A | 4/2000 | Meschan |
| D424,794 | S | 5/2000 | Garcia |
| 6,055,747 | A | 5/2000 | Lombardino |
| 6,082,023 | A | 7/2000 | Dalton |
| D429,877 | S | 8/2000 | Lozano et al. |
| 6,098,313 | A | 8/2000 | Skaja |
| 6,115,943 | A | 9/2000 | Gyr |
| D431,898 | S | 10/2000 | Clegg et al. |
| 6,125,557 | A | 10/2000 | Brown |
| 6,131,310 | A | 10/2000 | Fang |
| D433,216 | S | 11/2000 | Avar et al. |
| 6,195,915 | B1 | 3/2001 | Russell |
| 6,195,920 | B1 | 3/2001 | Morris et al. |
| 6,205,682 | B1 | 3/2001 | Park |
| 6,205,684 | B1 | 3/2001 | Snyder |
| 6,266,898 | B1 | 7/2001 | Cheng |
| D446,923 | S | 8/2001 | McCourt |
| D450,437 | S | 11/2001 | Simpson et al. |
| 6,327,795 | B1 | 12/2001 | Russell |
| 6,330,757 | B1 | 12/2001 | Russell |
| 6,393,731 | B1 | 5/2002 | Moua et al. |
| 6,823,612 | B2 | 11/2004 | Manz et al. |
| 2001/0010129 | A1 | 8/2001 | Russell |
| 2001/0018806 | A1 | 9/2001 | Snyder |
| 2001/0034957 | A1 | 11/2001 | Doerer et al. |
| 2002/0023374 | A1 | 2/2002 | Russell |
| 2002/0088140 | A1 | 7/2002 | Wang et al. |

FOREIGN PATENT DOCUMENTS

| | | |
|---|---|---|
| DE | 199 55 550 | 12/2000 |
| EP | 0 510 943 B1 | 9/1995 |
| GB | 2 221 378 | 2/1990 |
| GB | 2 273 037 | 6/1994 |
| WO | 98/07343 | 2/1998 |
| WO | 01/70064 | 9/2001 |

OTHER PUBLICATIONS

European Search Report for WO 01/70064 (Oct. 3, 2001).

* cited by examiner

FULL BEARING 3D CUSHIONING SYSTEM

CROSS-REFERENCE TO RELATED APPLICATION

This application incorporates by reference, and claims priority to and the benefit of, German patent application serial number 10244435.8 that was filed on Sep. 24, 2002.

TECHNICAL FIELD

The present invention relates to a sliding element for a shoe sole, in particular a shoe sole with a sliding element that provides cushioning to the shoe in three dimensions.

BACKGROUND

Shoe soles should primarily meet two requirements. First, they should provide good friction with the ground. Second, they should sufficiently cushion the ground reaction forces arising during a step cycle to reduce the strains on the wearer's muscles and bones. These ground reaction forces can be classified into three mutually orthogonal components, i.e., a component occurring in each of the X-direction, the Y-direction, and the Z-direction. The Z-direction designates a dimension essentially perpendicular (or vertical) to the ground surface. The Y-direction designates a dimension essentially parallel to a longitudinal axis of a foot and essentially horizontal relative to the ground surface. The X-direction designates a dimension essentially perpendicular to the longitudinal axis of the foot and essentially horizontal relative to the ground surface.

The largest ground reaction force component typically occurs in the Z-direction. Studies have shown that peak forces of approximately 2000 N may occur in the Z-direction during running. This value is about 2.5 to 3 times the body weight of a typical runner. Accordingly, in the past, the greatest attention was directed to the strains of the muscles and the bones caused by this force component and the many different arrangements for optimizing the cushioning properties of a shoe in the Z-direction.

Ground reaction forces, however, further include noticeable force components in the X-direction and in the Y-direction. Measurements have shown that forces of approximately 50 N in the X-direction and of approximately 250 N in the Y-direction may occur in a heel area during running. During other sports, for example lateral sports such as basketball or tennis, forces of up to 1000 N may occur in a forefoot area in the X-direction during side cuts, impact, and push off.

The aforementioned horizontal forces in the X- and Y-directions are one reason why running on an asphalt road is considered uncomfortable. When the shoe contacts the ground, its horizontal movement is essentially completely stopped within a fraction of a second. In this situation, the horizontally effective forces, i.e., the horizontal transfer of momentum, are very large. This is in contrast to running on a soft forest ground, where the deceleration is distributed over a longer time period due to the reduced friction of the ground. The high transfer of momentum can cause premature fatigue of the joints and the muscles and may, in the worst case, even be the reason for injuries.

Further, many runners contact the ground with the heel first. If viewed from the side, the longitudinal axis of the foot is slightly inclined with respect to the ground surface (i.e., dorsal flexion occurs). As a result, a torque, which cannot be sufficiently cushioned by compression of a sole material in the Z-direction alone, is exerted on the foot during first ground contact. This problem becomes worse when the runner runs on a downhill path, since the angle between the shoe sole and the ground increases in such a situation.

In addition, road surfaces are typically cambered for better water drainage. This leads to a further angle between the sole surface and the ground plane. Additional loads, caused by a torque on the joints and the muscles, are, therefore, created during ground contact with the heel. With respect to this strain, the compression of the sole materials in the Z-direction alone again fails to provide sufficient cushioning. Furthermore, during trail running on soft forest ground, roots or similar bumps in the ground force the foot during ground contact into an anatomically adverse inclined orientation. This situation leads to peak loads on the joints.

There have been approaches in the field to effectively cushion loads that are not exclusively acting in the Z-direction. For example, International Publication No. WO98/07343, the disclosure of which is hereby incorporated herein by reference in its entirety, discloses 3D-deformation elements that allow for a shift of the overall shoe sole with respect to a ground contacting surface. This is achieved by a shearing motion of an elastic chamber, where the walls are bent to one side in parallel so that the chamber has a parallelogram-like cross-section, instead of its original rectangular cross-section, under a horizontal load.

A similar approach can be found in U.S. Pat. No. 6,115,943, the disclosure of which is hereby incorporated herein by reference in its entirety. Two plates interconnected by means of a rigid linkage below the heel are shifted with respect to each other. The kinematics are similar to International Publication No. WO98/07343, i.e., the volume defined by the upper and lower plate, which is filled by a cushioning material, has an approximately rectangular cross-section in the starting configuration, but is transformed into an increasingly thin parallelogram under increasing deformation.

One disadvantage of such constructions is that cushioning is only possible along a single path, as predetermined by the mechanical elements. For example, the heel unit disclosed in U.S. Pat. No. 6,115,943 allows only a deflection in the Y-direction, which is simultaneously coupled to a certain deflection in the Z-direction. With respect to forces acting in the X-direction, the sole is substantially rigid. Another disadvantage of such constructions is that the horizontal cushioning is not decoupled from the cushioning in the Z-direction. Modifications of the material or design parameters for the Z-direction can have side effects on the horizontal directions and vice versa. Accordingly, the complex multi-dimensional loads occurring during the first ground contact with the heel, in particular in the above discussed situations with inclined road surfaces, cannot be sufficiently controlled.

Further, U.S. Pat. No. 5,224,810, the disclosure of which is also hereby incorporated herein by reference in its entirety, discloses dividing the overall sole of a shoe into two wedge-like halves which are shifted with respect to each other, wherein the movement is limited to the X-direction by means of corresponding ribs. Cushioning for ground reaction forces acting in the longitudinal direction (i.e., the Y-direction) of the shoe is not disclosed. In particular, the system does not provide any cushioning during ground contact with the heel.

It is, therefore, an object of the present invention to provide a cushioning element for a shoe sole that reduces loads on the muscles and the bones caused by multi-dimensional ground reaction forces, in particular during the first ground contact with the heel, thereby overcoming the above discussed disadvantages of the prior art.

SUMMARY OF THE INVENTION

The invention relates to a sliding element for a shoe sole, in particular a sports shoe with an upper sliding surface and a lower sliding surface, wherein the lower sliding surface is arranged below the upper sliding surface so as to be slideable in at least two directions. A relative movement between the upper sliding surface and the lower sliding surface allows the foot to feel as if it is wearing a conventional shoe that contacts a surface with reduced friction, for example, a soft forest ground. The sliding movement of the surfaces distributes the deceleration of the sole over a greater time period. This, in turn, reduces the amount of force acting on the athlete and the momentum transfer on the muscles and the bones.

According to the invention, a sliding movement of the upper sliding surface relative to the lower sliding surface may occur in several directions. In contrast to the prior art, strains in the X-direction, as well as in the Y-direction, can therefore be effectively reduced. The two sliding surfaces interact without any side effects on the Z-direction. Thus, proven cushioning systems in the Z-direction can be combined, interference-free, with a sliding element in accordance with the invention.

Because the horizontal shear-movements can be optimized, the athlete can adjust the orientation of his or her lower extremities in such a way that the ground reaction force, which consists of the three components occurring in the X-, Y- and Z-directions and which is transferred as a load on the joints, is reduced. By reducing the lever arms in the knee joint and the ankle joint, the system can reduce the relevant frontal and transversal moments. Accompanying this reduction is a decrease of the shear-forces in the joints, which is also beneficial to the cartilage of the joints and the bases of the tendons. This is important to runners, because the typical injuries they suffer are degeneration of the cartilage and inflammation of the bases of the tendons.

In addition, a sliding element in accordance with the invention positively influences the moments and forces arising during running on cambered roads and during downhill running. A comparative study with conventional sole structures has shown that the sliding element allows measurable deflections, which noticeably reduce the loads arising during ground contact.

In one aspect, the invention relates to a sliding element for a shoe sole. The sliding element includes an upper sliding surface and a lower sliding surface. The lower sliding surface is arranged below the upper sliding surface, such as to be slideable in at least two directions.

In another aspect, the invention relates to a sole for an article of footwear. The sole includes at least one sliding element, which itself includes an upper sliding surface and a lower sliding surface. The lower sliding surface is arranged below the upper sliding surface, such as to be slideable in at least two directions.

In yet another aspect, the invention relates to an article of footwear including an upper and a sole. The sole includes at least one sliding element, which itself includes an upper sliding surface and a lower sliding surface. The lower sliding surface is arranged below the upper sliding surface, such as to be slideable in at least two directions.

In various embodiments of the foregoing aspects of the invention, at least one projection is arranged on one of the two sliding surfaces for engaging a corresponding recess on the other sliding surface to limit the sliding movement of one sliding surface with respect to the other sliding surface. In one embodiment, the lower sliding surface includes the projection for engaging the recess in the upper sliding surface. The projection can have a pin-like shape and the recess can have an elliptical shape. Moreover, the projection can have a starting position arranged at a top end of the elliptically shaped recess and a major axis of the elliptically shaped recess can be inclined with respect to a longitudinal axis of the shoe sole. In a further embodiment, at least one cushioning element is arranged in the recess to cushion the movement of the upper sliding surface with respect to the lower sliding surface.

In another embodiment, the upper sliding surface forms a lower side of an upper sliding plate and the lower sliding surface forms an upper side of a lower sliding plate. The lower sliding plate and the upper sliding plate can be similarly shaped. Moreover, the upper sliding plate and the lower sliding plate can include corresponding concave or convex shapes and can be slideable relative to one another in at least three directions.

Furthermore, the sliding element can include a spring element that is deflected by a sliding movement of the upper sliding surface relative to the lower sliding surface. The spring element can form an elastic envelope at least partially encompassing the upper sliding surface and the lower sliding surface. Moreover, the elastic envelope can seal an intermediate space between the upper sliding surface and the lower sliding surface and can include a lower side on which at least one profile element is disposed.

In still other embodiments, at least one sliding element is arranged in a heel area of the sole, for example on a lateral side of the heel area. In another embodiment, at least one sliding element is arranged in a forefoot area of the sole, for example on a rear section of the forefoot area. In yet another embodiment, the upper sliding surface is attached to a midsole of the sole.

These and other objects, along with the advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

The drawings are not necessarily to scale, emphasis instead generally being placed upon illustrating the principles of the invention. In the following description, various embodiments of the present invention are described with reference to the following drawings, in which.

DETAILED DESCRIPTION OF THE INVENTION

Embodiments of the present invention are described below. It is, however, expressly noted that the present invention is not limited to these embodiments, but rather the intention is that modifications that are apparent to the person skilled in the art are also included. In particular, the present invention is not intended to be limited to soles for sports shoes, but rather it is to be understood that the present invention can also be used to produce soles or portions thereof for any article of footwear. Further, only a left or right sole and/or shoe is depicted in any given figure; however, it is to be understood that the left and right soles/shoes are typically mirror images of each other and the description applies to both left and right soles/shoes. In certain activities that require different left and right shoe configurations or performance characteristics, the shoes need not be mirror images of each other.

Figure 1:
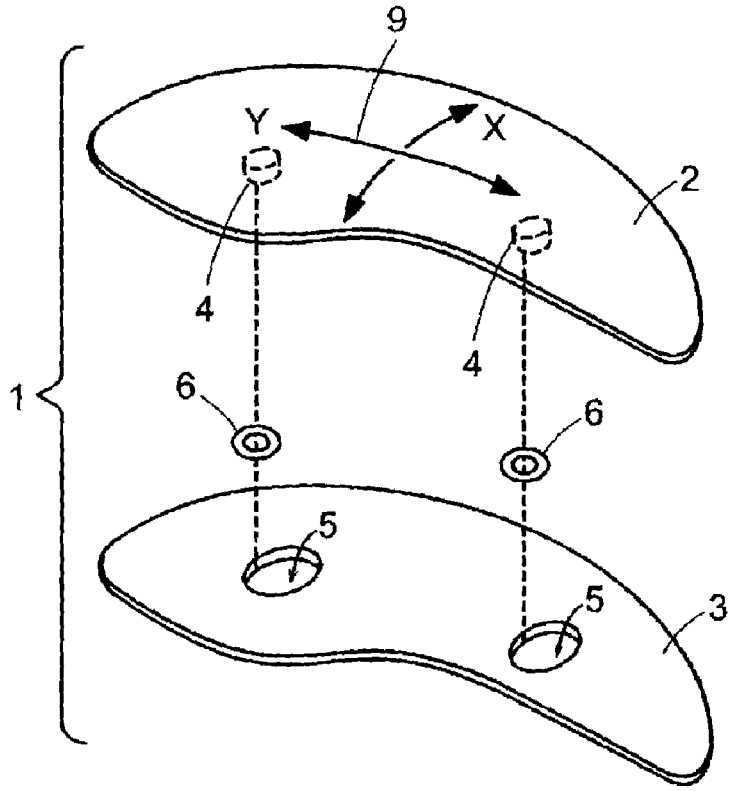
FIG. 1 is an exploded schematic perspective bottom view of a sliding element in accordance with the invention incorporating a lower sliding plate and an upper sliding plate.

FIG. 1 depicts one embodiment of a sliding element 1 in accordance with the invention. The sliding element 1 includes a lower sliding surface in the form of a lower sliding plate 2 and an upper sliding surface in the form of an upper sliding plate 3. In FIGS. 1–4 and 6, a bottom view is illustrated. The upper sliding plate 3, 43 and the lower sliding plate 2, 42, which are each defined with respect to a shoe in an upright orientation, therefore appear in FIGS. 1, 3, and 6 in an inverted arrangement.

As shown in FIG. 1, the lower sliding plate 2 and the upper sliding, plate 3 may be slightly curved elements. As such, the sliding element 1 can easily be integrated into the heel area 32 or the forefoot area 34 of a shoe sole 30 (see FIG. 6). In addition, independent cushioning can be added to the heel area 32 to provide cushioning in the Z-direction. In various embodiments, however, the lower sliding plate 2 and the upper sliding plate 3 may be concavely or convexly shaped to permit adaptation to the shoe sole 30 onto which they are arranged, to allow a better adaptation to the gait cycle, and/or to selectively provide a cushioning direction inclined with respect to the X-Y-plane, i.e., in the Z-direction. Alternatively, the sliding plates 2, 3 can be generally planar two-dimensional elements. As also shown in FIG. 1, the lower sliding plate 2 and the upper sliding plate 3 may be substantially identical in size and shape; however, the size and shape of the lower sliding plate 2 and upper sliding plate 3 can vary to suit a particular application.

In one embodiment, to reduce wear on one or both plates 2, 3, the lower sliding plate 2 and the upper sliding plate 3 may be made from materials having good sliding properties. Suitable plastic materials, as well as metals with a suitable coating, such as the Teflon® (polytetrafluoroethylene (PTFE)) brand sold by DuPont or a similar substance, may be used. Besides plastic or polymeric materials and coated metals, it is also possible to coat plastic materials with Teflon® or to compound Teflon® directly into the plastic material. Possible materials and manufacturing techniques are described in greater detail hereinbelow.

One of the sliding plates 2, 3 may include, on the sliding surface directed to the other sliding plate 2, 3, two pin-like projections 4. As indicated by the dashed lines in FIG. 1, the projections 4 may engage recesses 5 in the corresponding sliding surface 2, 3. In one embodiment, the projections 4 are arranged on the lower sliding plate 2 and the recesses 5 are provided on the upper sliding plate 3. A reverse arrangement, however, is also possible. Furthermore, it is possible to use only a single projection 4 and a single recess 5, as well as any other numbers of these elements. As shown in FIG. 1, the projections 4 and corresponding recesses 5 are spaced relatively linearly along a longitudinal axis 9 of the sliding plates 2, 3. Alternatively, the projections 4 and corresponding recesses 5 may be spaced in any arrangement about the sliding plates 2, 3.

The recess 5 is larger than the projection 4. The resulting play of the projection 4 within the corresponding recess 5 determines the extent of the relative sliding movement between the lower sliding plate 2 and the upper sliding plate 3. Excessive shifts of the lower sliding plate 2 relative to the upper sliding plate 3 are avoided, and the stability of the sliding element 1 maintained, through the interaction of the projection 4 and the corresponding recess 5.

Figure 6:
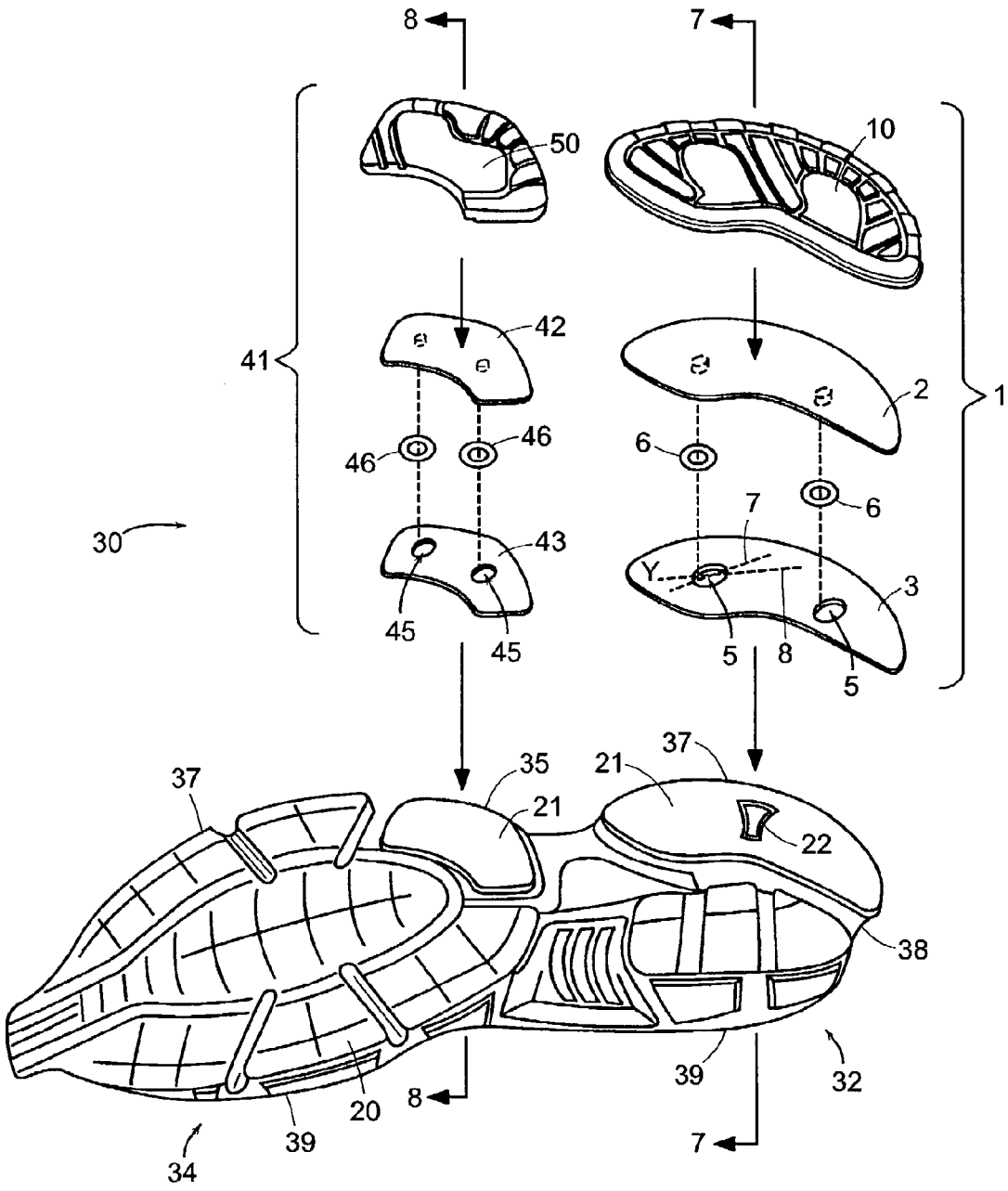
FIG. 6 is an exploded schematic perspective bottom view of a shoe sole with the sliding elements of FIGS. 1 and 3 and the spring elements of FIGS. 2 and 4.

In general, sliding movements of the lower sliding plate 2 relative to the upper sliding plate 3 are possible in the X-direction as well as in the Y-direction. In the embodiment shown in FIG. 1, the recesses 5 are generally elliptical in shape; however, the shape and size of the recesses 5 can vary to suit a particular application. As shown in FIG. 6, when the sliding element 1 is arranged on a shoe sole 30, a major axis 7 of the elliptical recess 5 can have an inclined orientation with respect to a longitudinal axis 8 of the shoe sole 30. Such an arrangement is particularly suitable for cushioning the ground reaction forces occurring in the X- and Y-directions in the heel area 32, as it allows for maximum deflection of the lower sliding plate 2 along the major axis 7 of the elliptic recess 5, i.e., in an inclined direction with respect to the longitudinal axis 8 of the shoe sole 30. Further, as described above, in various embodiments the lower sliding plate 2 and the upper sliding plate 3 may be concavely or convexly shaped. A lower sliding plate 2 and an upper sliding plate 3 having such shapes are particularly useful for cushioning the ground reaction forces occurring in the Z-direction in the heel area 32, as they allow for a sliding movement of the lower sliding plate 2 relative to the upper sliding plate 3 in an inclined direction with respect to the ground surface (i.e., the X-Y plane).

Figure 2:
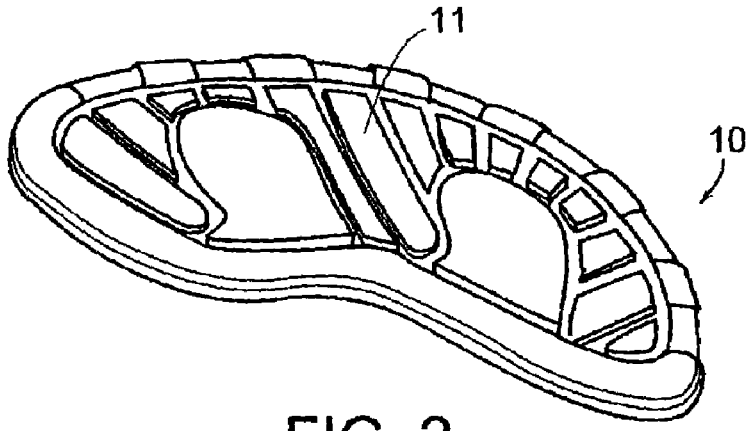
FIG. 2 is a schematic perspective bottom view of an embodiment of a spring element for use with the sliding element of FIG. 1.

FIG. 2 depicts one embodiment of a spring element 10 in accordance with the invention. In the embodiment shown, the spring element 10 is shaped so that the projection 4 is in the non-deflected, or neutral, position when situated at the front end of the elliptical recess 5. When the sliding element 1 is positioned in a lateral side 37 of the heel area 32 of the shoe sole 30, as shown in FIG. 6, maximum deflection of the lower sliding plate 2 relative to the upper sliding plate 3 occurs towards the lateral side 37 and a back end 38 of the shoe sole 30 in a direction inclined relative to the longitudinal axis 8 of the shoe sole 30. This is one way to compensate for the ground reaction forces that arise during first ground contact. Other movement patterns of the lower sliding plate 2 relative to the upper sliding plate 3 can be easily achieved by modifying the shape of the recess 5. This may be desirable if the sliding element 1 is to be arranged in a different area of the shoe sole 30 than as shown in FIG. 6.

In another embodiment, the lower sliding plate 2 or the upper sliding plate 3, whichever comprises the recesses 5, is releasably arranged, thereby allowing an athlete to select and mount a differently designed sliding plate 2, 3 and to, therefore, easily adapt the sliding element 1 to his or her individual requirements. In yet another embodiment, to allow for multi-level horizontal cushioning, several sliding plates 2, 3 may be stacked on top of each other and provided with suitable projections 4 and corresponding recesses 5.

Referring again to FIG. 2, the spring element 10 may form an elastic envelope enclosing the lower sliding plate 2 and the upper sliding plate 3. When the lower sliding plate 2 and the upper sliding plate 3 shift relative to one another, the overall area taken up by the sliding plates 2, 3 increases and the spring element 10 is thereby elongated and/or deformed. The spring element 10 provides a restoring force to bring the lower sliding plate 2 and the upper sliding plate 3 back into their neutral or starting positions. The material properties and the wall thickness of the spring element 10 determine the dynamic properties of the sliding element 1. In other words, the material properties and the wall thickness of the spring element 10 determine the resistance that the spring element 10 will offer against a sliding movement of the lower sliding plate 2 relative to the upper sliding plate 3.

Still referring to FIG. 2, the spring element 10 may include on its bottom side a plurality of profile elements 11 in order to provide good friction with the ground. The exact design of the profile elements 11 depends on the intended field of use of the shoe to which the sliding element 1 is arranged. In addition, materials for providing cushioning in the Z-direction (e.g., cushioning elements made from foamed ethylene vinylene acetate ("EVA")) may be provided on the bottom side of the spring element 10. In a further embodiment, a thin layer of EVA is arranged between the lower sliding plate 2 and an additional outsole layer 71. The outsole layer 71 is mounted on the bottom side of the sliding element 1 as a separate component from the spring element 10 (see FIG. 7).

To ensure that the sliding movement of the lower sliding plate 2 relative to the upper sliding plate 3 is not impaired by the penetration of dirt into an intermediate space between the lower sliding plate 2 and the upper sliding plate 3, the spring element 10 encompasses the lower sliding plate 2 and the upper sliding plate 3 at least along the sides, thereby enclosing the intermediate space between the plates. Where the sliding element 1 is positioned on the outer surface of the shoe sole 30, the spring element 10 may enclose the bottom side of the sliding element 1, which is directed to the ground surface, and profile elements 11 may be arranged on the bottom side of the spring element 10. The top side of the spring element 10 may be open so that the top side of the upper sliding plate 3 can be directly mounted to the bottom side of a shoe sole 30.

Referring again to FIG. 1, cushioning elements 6 may additionally or alternatively be arranged in the recesses 5 to cushion the movements of the projections 4 inside the recesses 5. These cushioning elements 6 further impact the dynamic properties of the sliding element 1. In addition, the cushioning elements 6 can provide cushioning to the shoe in the Z-direction.

Figure 5:
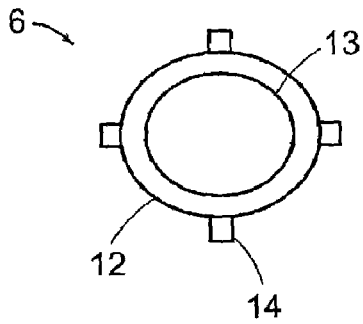
FIG. 5 is a schematic plan view of a cushioning element for use with the sliding elements of FIGS. 1 and 3.

FIG. 5 depicts one embodiment of a cushioning element 6 in accordance with the invention. In the embodiment shown, the outer edge 12 and the inner edge 13 of the cushioning element 6 are generally elliptical in shape; however, the shape of one or both of the outer edge 12 and the inner edge 13 can vary to suit the particular recess 5 in which the cushioning element 6 is disposed. Moreover, any number of projections 14 may be arranged, in any position, on the outer edge 12 of the cushioning element 6 to control the positioning of the cushioning element 6 in the recess 5. The width of the cushioning element 6, as measured from the outer edge 12 to the inner edge 13, can vary to suit the amount of cushioning required by a particular application. In addition, the height of the cushioning element 6 can vary to provide different amounts of cushioning to the shoe in the Z-direction.

Each projection 4 of one of the sliding plates 2, 3 may sit within the aperture defined by the inner edge 13 of one of the cushioning elements 6. The size and shape of the aperture defined by the inner edge 13 of the cushioning element 6 may determine the extent and direction of the relative sliding movement between the lower sliding plate 2 and the upper sliding plate 3.

Figure 3:
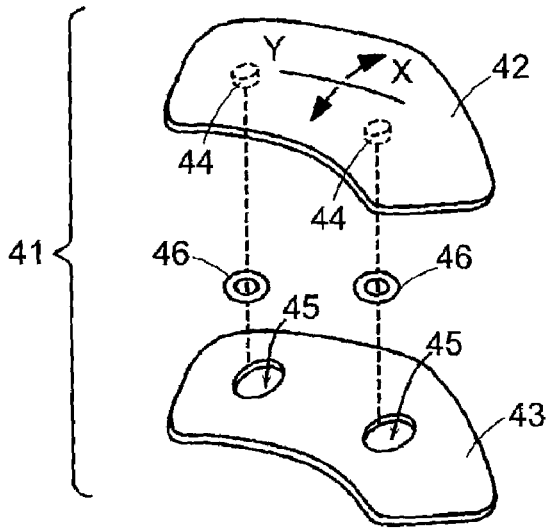
FIG. 3 is an exploded schematic perspective bottom view of an alternative sliding element in accordance with the invention incorporating a lower sliding plate and an upper sliding plate.

FIG. 3 depicts a smaller embodiment of a sliding element 41 in accordance with the invention. The sliding element 41 is similar in structure and operation to sliding element 1. The sliding element 41 includes a lower sliding surface in the form of a lower sliding plate 42 and an upper sliding surface in the form of an upper sliding plate 43. One of the sliding plates 42, 43 may include, on the sliding surface directed to the other sliding plate 42, 43, pin-like projections 44 for engaging recesses 45 in the corresponding sliding surface 42, 43. Further, cushioning elements 46 may additionally or alternatively be arranged in the recesses 45 to cushion the movements of the projections 44 inside the recesses 45.

Figure 4:
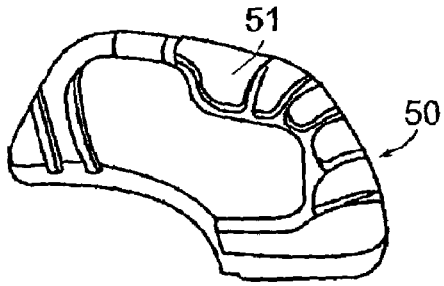
FIG. 4 is a schematic perspective bottom view of an embodiment of a spring element for use with the sliding element of FIG. 3.

FIG. 4 depicts one embodiment of a spring element 50 in accordance with the invention. The spring element 50 is similar in structure and operation to spring element 10. The spring element 50 may form an elastic envelope enclosing the lower sliding plate 42 and the upper sliding plate 43 and may include on its bottom side a plurality of profile elements 51.

The design of this smaller sliding element 41, which, as shown in FIG. 6, is used in the forefoot area 34 of the shoe sole 30, differs from the above-described larger embodiment of the sliding element 1, apart from its smaller dimensions, only by the substantially equal planar shape of the lower sliding plate 42 and the upper sliding plate 43. This difference in design reflects the different positioning of the two sliding elements 1, 41 on the shoe sole 30, as shown in FIG. 6. Whereas the smaller sliding element 41 is arranged in the almost completely flat rear section 35 of the forefoot area 34, the larger sliding element 1 is arranged on the lateral side 37 of the back end 38 of the heel area 32. The larger sliding element 1 facilitates, by its slightly curved configuration, the rolling-off of the shoe.

The various components of the sliding elements 1, 41 can be manufactured by, for example, injection molding or extrusion. Extrusion processes may be used to provide a uniform shape, such as a single monolithic frame. Insert molding can then be used to provide the desired geometry of, for example, the recesses 5, 45. Other manufacturing techniques include melting or bonding additional portions. For example, the projections 4, 44 may be adhered to the lower sliding plate 2, 42 with a liquid epoxy or a hot melt adhesive, such as ethylene vinyl acetate (EVA). In addition to adhesive bonding, portions can be solvent bonded, which entails using a solvent to facilitate fusing of the portions to be added to the sole 30. The various components can be separately formed and subsequently attached or the components can be integrally formed by a single step called dual injection, where two or more materials of differing densities are injected simultaneously.

The various components can be manufactured from any suitable polymeric material or combination of polymeric materials, either with or without reinforcement. Suitable materials include: polyurethanes, such as a thermoplastic polyurethane (TPU); EVA; thermoplastic polyether block amides, such as the Pebax® brand sold by Elf Atochem; thermoplastic polyester elastomers, such as the Hytrel® brand sold by DuPont; thermoplastic elastomers, such as the Santoprene® brand sold by Advanced Elastomer Systems, L.P.; thermoplastic olefin; nylons, such as nylon 12, which may include 10 to 30 percent or more glass fiber reinforcement; silicones; polyethylenes; acetal; and equivalent materials. Reinforcement, if used, may be by inclusion of glass or carbon graphite fibers or para-aramid fibers, such as the Kevlar® brand sold by DuPont, or other similar method. Also, the polymeric materials may be used in combination with other materials, for example rubber. Other suitable materials will be apparent to those skilled in the art.

FIG. 6 depicts one embodiment of the shoe sole 30 for an article of footwear 70 (see FIG. 7) incorporating the above-described sliding elements 1, 41 in accordance with the invention. Receiving surfaces 21, to which the upper sliding plates 3, 43 of the respective sliding elements 1, 41 may be attached, can be provided on the midsole body 20. Many different mounting methods, such as gluing or melting, may be used. In another embodiment, the upper sliding surface 3, 43 may be directly integrated into the midsole body 20 during its manufacture and corresponding projections 4, 44 or recesses 5, 45 may be directly arranged in the midsole body 20.

Figure 7:
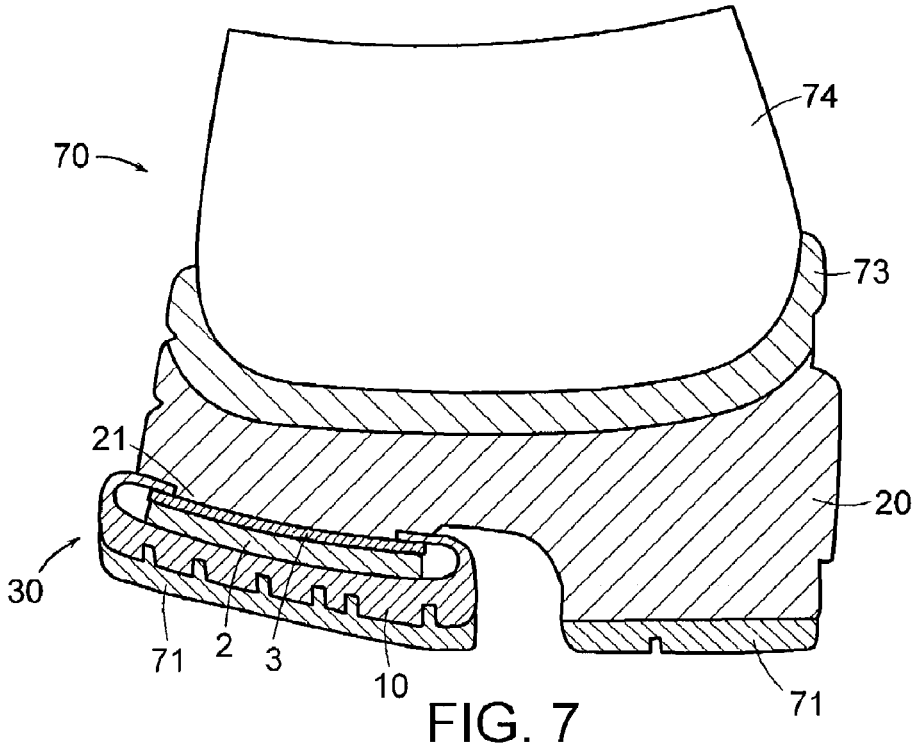
FIG. 7 is a schematic cross-sectional view of the shoe sole of FIG. 6 taken at line 7—7.
Figure 8:
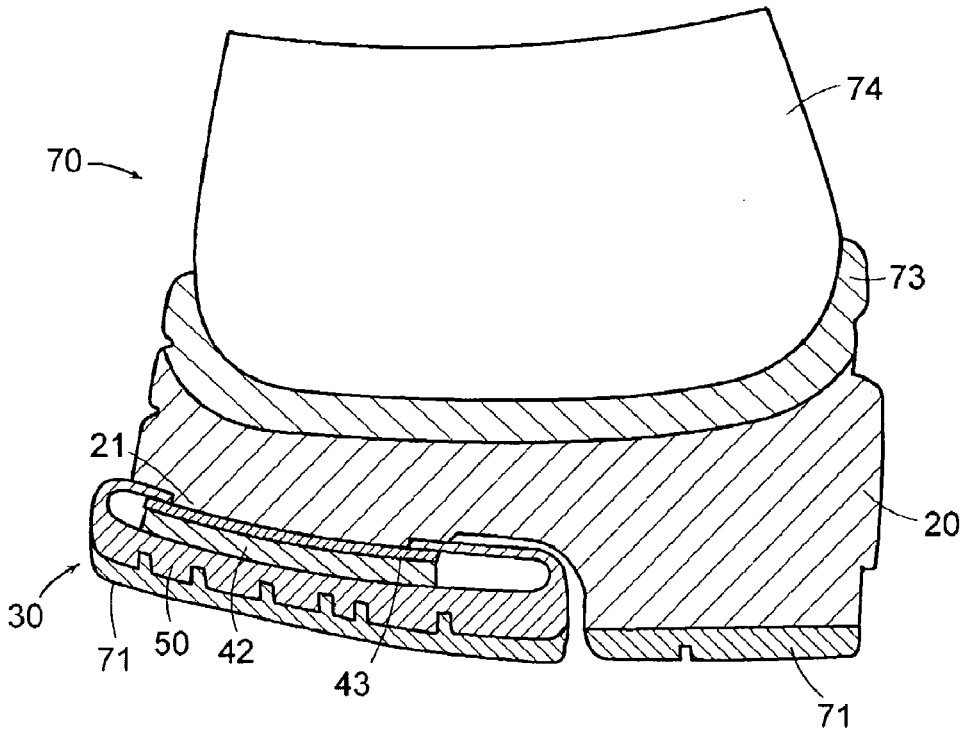
FIG. 8 is a schematic cross-sectional view of the shoe sole of FIG. 6 taken at line 8—8.

The sliding elements 1, 41 can be arranged between the midsole 20 and the outsole layer 71, as shown in the embodiments illustrated in FIGS. 7 and 8. Alternatively, the sliding elements 1, 41 may be integrated into the midsole 20 by being arranged between different layers of the midsole 20. In yet another embodiment, the sliding elements 1, 41 may be arranged between the insole 73 (see FIGS. 7 and 8) and the midsole 20.

The distribution of the sliding elements 1, 41 on the shoe sole 30, as shown in FIG. 6, is only one possible arrangement. Other arrangements, wherein sliding elements 1 are exclusively arranged in the heel area 32 or sliding elements 41 are exclusively provided in the forefoot area 34, are also possible. The distribution depends on the preferred field of use for the shoe. With respect to the heel area 32, for linear sports the sliding element 1 may be arranged on the lateral side 37 and for lateral sports the sliding element 1 may be arranged on the medial side 39. These are the areas of the sole 30 most affected by the horizontal ground reaction forces during ground contact with the heel. Selectively providing sliding elements 1 in these positions affords maximum cushioning during ground contact with the heel, without substantially influencing the other properties of the sole 30. With respect to the forefoot area 34, a sliding element 41 arranged in the rear section 35 of the forefoot area 34 cushions, in particular, the horizontal ground reaction forces occurring during lateral stops and is particularly useful in sports with many changes of direction, such as basketball.

For a running shoe, sliding elements 1 are particularly useful in the heel area 32. A basketball shoe may also be equipped with one or more sliding elements 41 in the forefoot area 34. Thus, in a further embodiment of a basketball shoe (not shown), three decoupled sliding elements 41 are arranged in the forefoot area 34 on the medial side 39 of the shoe sole 30 and two further decoupled sliding elements 1 are arranged in the heel area 32 on the medial side 39 of the shoe sole 30.

For reinforcing the attachment of the sliding elements 1, 41 to the shoe sole 30 and for a more stable anchoring, the top side of the upper sliding plates 3, 43, which may be directly attached to the shoe sole 30, may be three-dimensionally shaped to interact with corresponding projections 22 on the receiving surfaces 21. In one embodiment, the receiving surfaces 21 are part of the midsole body 20. It is, however, also possible to arrange the sliding elements 1 on suitable areas of the outsole layer 71.

In yet another embodiment, the sliding elements 1, 41 may be provided as modular components that can be releasably attached to the shoe sole 30, as required. Such an embodiment is useful for adapting a running shoe to a particular ground surface. For example, one or more sliding elements 1, 41 used for running on asphalt may be replaced by lighter common outsole elements for running in the woods, or by other sliding elements 1, 41, which can be optimally adjusted for the respective type of surface.

FIG. 7 depicts a cross-sectional view of one embodiment of a shoe sole 30 for an article of footwear 70 in accordance with the invention. The article of footwear 70 can include any type of upper 74. As shown, the lower sliding plate 2 and the upper sliding plate 3 may be arranged, as described above, between the outsole layer 71 and the midsole 20. Moreover, as described above, a spring element 10 may form an elastic envelope enclosing the lower sliding plate 2 and the upper sliding plate 3. Also as shown, the lower sliding plate 2 and the upper sliding plate 3 are at least partially in contact.

FIG. 8 also depicts a cross-sectional view of one embodiment of a shoe sole 30 for an article of footwear 70 in accordance with the invention. As shown, the article of footwear 70 can include any type of upper 74. The lower sliding plate 42 and the upper sliding plate 43 may be arranged, as described above, between an outsole layer 71 and a midsole 20. Moreover, as described above, a spring element 50 may form an elastic envelope enclosing the lower sliding plate 42 and the upper sliding plate 43. Also as shown, the lower sliding plate 42 and the upper sliding plate 43 are at least partially in contact.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. A sliding element for a shoe sole, comprising:

an upper sliding surface;

a lower sliding surface, wherein the lower sliding surface is arranged below the upper sliding surface such as to be slideable in at least two directions;

at least one projection arranged on one of the two sliding surfaces for engaging a corresponding recess at least partially defined by the other sliding surface to limit the sliding movement of one sliding surface with respect to the other sliding surface; and at least one cushioning element arranged in the recess to cushion the movement of the upper sliding surface with respect to the lower sliding surface.

2. The sliding element of claim 1, wherein the lower sliding surface comprises the projection for engaging the recess of the upper sliding surface.

3. The sliding element of claim 2, wherein the projection comprises a pin-like shape and the recess comprises an elliptical shape.

4. The sliding element of claim 3, wherein a major axis of the elliptically shaped recess is inclined with respect to a longitudinal axis of the shoe sole.

5. The sliding element of claim 4, wherein the projection comprises a starting position arranged at a top end of the elliptically shaped recess.

6. The sliding element of claim 1, wherein the upper sliding surface forms a lower side of an upper sliding plate and the lower sliding surface forms an upper side of a lower sliding plate and the upper sliding plate and the lower sliding plate are similarly shaped.

7. The sliding element of claim 6, wherein the upper sliding plate and the lower sliding plate comprise corresponding concave and convex shapes.

8. The sliding element of claim 7, wherein the lower sliding plate is slideable relative to the upper sliding plate in at least three directions.

9. The sliding element of claim 1, further comprising a spring element, wherein the spring element is deflected by a sliding movement of the upper sliding surface relative to the lower sliding surface.

10. The sliding element of claim 9, wherein the spring element forms an elastic envelope at least partially encompassing the upper sliding surface and the lower sliding surface.

11. The sliding element of claim 10, wherein the elastic envelope seals an intermediate space between the upper sliding surface and the lower sliding surface.

12. The sliding element of claim 11, wherein the elastic envelope comprises a lower side including at least one profile element disposed thereon.

13. A sole for an article of footwear, the sole comprising:

at least one sliding element, comprising:

an upper sliding surface;

a lower sliding surface, wherein the lower sliding surface is arranged below the upper sliding surface such as to be slideable in at least two directions;

at least one projection arranged on one of the two sliding surfaces for engaging a corresponding recess at least partially defined by the other sliding surface to limit the sliding movement of one sliding surface with respect to the other sliding surface; and at least one cushioning element arranged in the recess to cushion the movement of the upper sliding surface with respect to the lower sliding surface.

14. The sole of claim 13, wherein the upper sliding surface is attached to a midsole of the sole.

15. The sole of claim 13, wherein the at least one sliding element is arranged in a heel area of the sole.

16. The sole of claim 15, wherein the at least one sliding element is arranged on a lateral side of the heel area.

17. The sole of claim 13, wherein the at least one sliding element is arranged in a forefoot area of the sole.

18. The sole of claim 17, wherein the at least one sliding element is arranged on a rear section of the forefoot area.

19. The sole of claim 13, wherein the upper sliding surface forms a lower side of an upper sliding plate and the lower sliding surface forms an upper side of a lower sliding plate and the upper sliding plate and the lower sliding plate are similarly shaped.

20. The sole of claim 19, wherein the upper sliding plate and the lower sliding plate comprise corresponding concave and convex shapes.

21. The sole of claim 20, wherein the lower sliding plate is slideable relative to the upper sliding plate in at least three directions.

22. An article of footwear including an upper and a sole, the sole comprising:

at least one sliding element, comprising:

an upper sliding surface;

a lower sliding surface, wherein the lower sliding surface is arranged below the upper sliding surface such as to be slideable in at least two directions;

at least one projection arranged on one of the two sliding surfaces for engaging a corresponding recess at least partially defined by the other sliding surface to limit the sliding movement of one sliding surface with respect to the other sliding surface; and at least one cushioning element arranged in the recess to cushion the movement of the upper sliding surface with respect to the lower sliding surface.

23. The article of footwear of claim 22, wherein the upper sliding surface forms a lower side of an upper sliding plate and the lower sliding surface forms an upper side of a lower sliding plate and the upper sliding plate and the lower sliding plate are similarly shaped.

24. The article of footwear of claim 23, wherein the upper sliding plate and the lower sliding plate comprise corresponding concave and convex shapes.

25. The article of footwear of claim 24, wherein the lower sliding plate is slideable relative to the upper sliding plate in at least three directions.

* * * * *